United States Patent [19]

Monselle

[11] 4,244,297

[45] Jan. 13, 1981

[54] ARTICULATED RAILWAY CAR TRUCKS

[76] Inventor: Dale E. Monselle, 116 S. 44th St., Omaha, Nebr. 68131

[21] Appl. No.: 757,146

[22] Filed: Jan. 6, 1977

Related U.S. Application Data

[63] Continuation-in-part of Ser. No. 408,469, Oct. 23, 1973, Pat. No. 4,003,316.

[51] Int. Cl.[3] ..... B61F 3/08; B61F 5/12; B61F 5/38; B61F 5/52

[52] U.S. Cl. ..... 105/168; 105/182 R; 105/197 D; 105/208; 105/224.1

[58] Field of Search ..... 105/165, 166, 167, 168, 105/182 R, 193, 197 A, 197 D, 208, 208.1, 208.2, 224, 224.1, 176; 267/54 A; 403/220, 225, 226, 227, 228

[56] References Cited

U.S. PATENT DOCUMENTS

| | | | |
|---|---|---|---|
| 220,928 | 10/1879 | Marsters | 105/165 |
| 1,640,179 | 8/1927 | Buckwalter | 105/182 R |
| 1,707,046 | 3/1929 | Boyden | 105/165 |
| 1,772,928 | 8/1930 | Kijlstra | 105/182 R |
| 2,296,106 | 9/1942 | Holland et al. | 105/167 |
| 2,360,061 | 10/1944 | Jones | 105/167 |
| 2,719,711 | 10/1955 | Nallinger | 403/225 |
| 3,211,112 | 10/1965 | Baker | 105/224.1 |
| 3,575,403 | 4/1971 | Hamel et al. | 105/197 A |
| 3,787,770 | 1/1970 | Cote et al. | 324/178 |
| 3,789,770 | 2/1974 | List | 105/168 |
| 3,862,606 | 1/1975 | Scales | 105/167 |
| 3,989,126 | 11/1976 | Katzer | 267/54 A |
| 4,003,316 | 1/1977 | Monselle | 105/182 R |
| 4,067,261 | 1/1978 | Scheffel | 105/224.1 |
| 4,067,262 | 1/1978 | Scheffel | 105/224.1 |
| 4,131,069 | 12/1978 | List | 105/176 |
| 4,134,343 | 1/1979 | Jackson | 105/224.1 |
| 4,151,801 | 5/1979 | Scheffel et al. | 105/224.1 |

OTHER PUBLICATIONS

Modern Railways, Self-Steering Truck Under Test, Feb. 1974, p. 81.

Devine Manufacturing Co., Radial Tracking Truck.

Railway Age, Steering-Type Freight Car Truck Offers End To Truck Hunting, Oct. 13, 1975.

Railway Age, GSI to Develop Radial Passenger-Car Truck, Jul. 26, 1976.

Railway Age, Engineers Foresee Reduction In Wear From Heavy Axle Loads; Nov. 24, 1975.

Railway Age, Self-Steering Truck is Being Tested, Oct. 29, 1973.

Railway Locomotive And Cars, Articulated Truck Tested, Nov. 1973, pp. 36 and 37.

Scheffle, Herbert, The Hunting Stability and Curving Ability of Railway Vehicles, Rail Internatinal, Feb. 1974, pp. 154-176.

Scheffel, Herbert, A New Design for Railway Vehicle Suspension, Rail International, Oct. 1974, pp. 638-676.

Widens, A. H., Steering and Dynamic Ability of Railway Vehicles, Vehicle System Dynamics, vol. V, No. 1-z Aug. 1975, pp. 14-46.

Hadden, A. J. and Law, E. H., ASME Paper 76--WA/RT-1.

List, H. A., Proposed Solutions to the Freight Car Truck Problems of Flange Wear and Truck Hunting, Dec. 4, 1975, pp. 1-7, ASME Paper 75 WA/RT-8.

List, H.A., An Evaluation of Recent Development in Rail Car Truck Design, Apr. 21, 1971, pp. 1-8, ASME Paper 71-RR-1.

*Primary Examiner*—Howard Beltran

*Attorney, Agent, or Firm*—Neuman, Williams, Anderson & Olson

[57] ABSTRACT

An articulated railway truck assembly is provided with a pair of side frames, a transverse center support structure and a pair of wheelset swiveling assemblies. An inward portion of each of the wheelset swiveling assemblies is supported by either the side frames or the center support structure, permitting both substantially universal pivotal movement of the respective wheelset swiveling assembly and lateral movement of the respective inward portion thereof relative to the center support structure. The wheelset swiveling assemblies are resiliently interconnected by a pivot point type connection near the center of the truck for pivoting each wheelset swiveling assembly against the other within the truck framework. Each wheelset swiveling assembly extends beneath respective adjacent ends of the side frames of the truck assembly, and resilient support connectors are disposed between and joined to the adjacent portions of each wheelset swiveling assembly and side frame for permitting a horizontal swiveling movement of each wheelset swiveling assembly relative to the truck frame by resilient deformation of the connectors, whereby the connectors provide restoring forces for returning the wheelset swiveling assemblies to the "square" position.

51 Claims, 21 Drawing Figures

ARTICULATED RAILWAY CAR TRUCKS

This application is a continuation-in-part of application Ser. No. 408,469 filed Oct. 23, 1973 which issued as U.S. Pat. No. 4,083,316 on Jan. 18, 1977.

Three-piece trucks composed of a bolster sprung on two side frames have been in common use for freight car service for many years in the United States. The inherent limitations of such three-piece trucks have long been recognized, particularly that of the guidance ability of the truck for curve negotiation and the restraint of the wheelsets for control of the hunting motion inherent in the use of wheels with nominally conically profiled treads. Because of such limitations, various alternative truck designs previously have been proposed including variations of three-piece trucks, square or rigid frame trucks, flexible type trucks and articulated trucks. However, simplicity and low initial cost have remained the major considerations in truck choice and it is here that the three-piece truck enjoys its greatest advantage. Hence, with continued refinement of three-piece trucks, the performance of such trucks has been considered acceptable.

In recent years there has been a marked increase in freight car truck service requirements. Such factors as increased train operating speeds, larger cars, and cars of higher centers of gravity, now appear to be putting a definite limit on the acceptability of the conventional three-piece truck. A truck design of considerably improved operating capability is needed. Such a truck should offer improved tracking or guidance ability resulting in a significant decrease in the relative wheel flange forces developed on track curves, effective control of wheel hunting motion at all operating speeds, improved vertical and lateral ride quality for both light and fully loaded cars, improved car body lateral roll stability, and a reduction in the frequency and cost of truck and track maintenance.

Conventional four-wheel railway car truck wheelsets with nominally conical tread wheels for supporting the truck frame would, if the wheel axle ends were unrestrained for-and-aft, each tend to assume a radial position to the rail upon entering a track curve. Such inherent self-steering is the result of a component set of wheel/rail creep and curving forces acting on the four wheels of the truck traversing a moderate track curve. Alignment of the wheel axles as a result of such inherent self-steering tends to put the two wheelsets of a four-wheel truck in an angular or turning position relative to one another, thereby minimizing wheel flange guiding forces on the outer lead wheel, tread skidding on all four wheels, and wheel and rail wear, and increasing operating efficiency. This inherent self-steering mechanism has been utilized in the design of various proposed radial type trucks.

It is also recognized that in a truck construction utilizing the before mentioned self-steering mechanism, that the self-steering capability can be further improved upon by a mechanism producing a balancing between wheelsets of the total wheelset swiveling or steering moments acting on the two wheel-sets, thus equalizing or attempting to equalize the yaw angles assumed by the respective wheelsets with respect to the truck frame. Principal advantages of such an added balancing mechanism are an improved truck steering or yaw angle assumed between the wheelsets within the truck frame and greater swiveling of the truck frame relative to the car body over that which would occur with only the inherent self-steering mechanism acting alone.

Moreover, a relative turning or yaw motion between wheelsets also lends itself to the effective control of wheel hunting motion on tangent track. Providing the proper resilient restraint to relative yaw motion between wheelsets will introduce the mechanism of creep damping between the wheels and rails, a recognized means of wheel-set hunting control.

Self-steering and balancing mechanisms are both incorporated in the truck designs of this invention. The balancing mechanism of this invention is a pivotal type connection between wheelsets in the center portion of the truck assembly, this connection in each case pivoting each wheelset against the other within the truck framework. Involved is the proper design of resilient restraint to yaw and lateral motions between wheelsets. Yaw motion between wheelsets refers to an opposed horizontal swiveling movement of the wheelsets which is required by the midtruck interconnection of the wheelsets. Lateral motion refers to an opposed relative lateral (perpendicular to the track direction) movement between wheelsets which is opposed by the midtruck interconnection of the wheelsets.

Other truck designs having a similar wheelset swiveling arrangement and referred to as articulated trucks having means for transmitting steering moments between axles are referred to in papers authored by H. A. LIST, ASME PAPER 71-RR-1 and ASME PAPER 75 WA/RT-8. Included are designs utilizing the three-piece frame of the conventional truck with its generally deep bolster design. Required in each case is a midtruck connection between wheelsets.

One object of this invention is to provide a simple and practical means for effecting a midtruck connection between wheelsets which facilitates anchoring of wheelset guidance frames or arms to a transverse support member, allowing those frames to also restrain the wheelset swiveling assemblies longitudinally, and obviates the need for large vertical height through-hole openings in a vertically movable bolster member to permit a direct midtruck connection between the wheelsets. Such hole openings would ordinarily be required to permit the up and down movement of the bolster associated with different static and dynamic car loading conditions.

It is an object of this invention to provide improved railway car truck assemblies having an effective steering capability and overcoming the problems outlined above with the conventional three-piece truck and truck frame.

A more particular object of this invention is to provide improved railway car trucks with good tracking ability and control of wheel hunting motion on both curved and tangent track, with improved vertical and lateral ride quality for both light and fully loaded cars, and improved lateral roll stability.

It is another object of this invention to provide railway car trucks which are improved over prior trucks and which provide many or all of the advantages of conventional three-piece trucks, particularly relative simplicity of construction, ease of assembly and maintenance, and a good load equalizing ability among wheels.

A further object of this invention is to provide improved freight car truck assemblies which meet the aforementioned objects and which are economical to produce and are rugged and reliable in operation and easy to maintain.

Further and additional objects and advantages of this invention will appear from the description, the accompanying drawings and the appended claims.

In carrying out this invention a railway truck is provided comprising a pair of longitudinally extending side frames, a transverse center support structure extending between and supported on the side frames and a pair of wheelset swiveling assemblies disposed one on each side of the center support structure. The wheelset swiveling assemblies are resiliently connected to the side frames at points spaced longitudinally outward of the truck from the center support structure and support the side frames. An inward portion of each of the wheelset swiveling assemblies is supportably engaged by either the center support structure or the side frames through a connection permitting both substantially universal pivotal movement of the respective wheelset swiveling assembly and lateral movement of the respective inward portion thereof relative to the center support structure. The inward portions of the wheelset swiveling assemblies are also resiliently connected to one another by a pivot point type connection near the center of the truck for pivoting each wheelset swiveling assembly against the other within the truck framework.

For a more complete understanding of this invention, references should now be had to the embodiments illustrated in the accompanying drawings and described below by way of examples of the invention. In these drawings, FIG. 1 is a plan view, partially in section, of a railway truck employing teachings of this invention;

Figure 1:
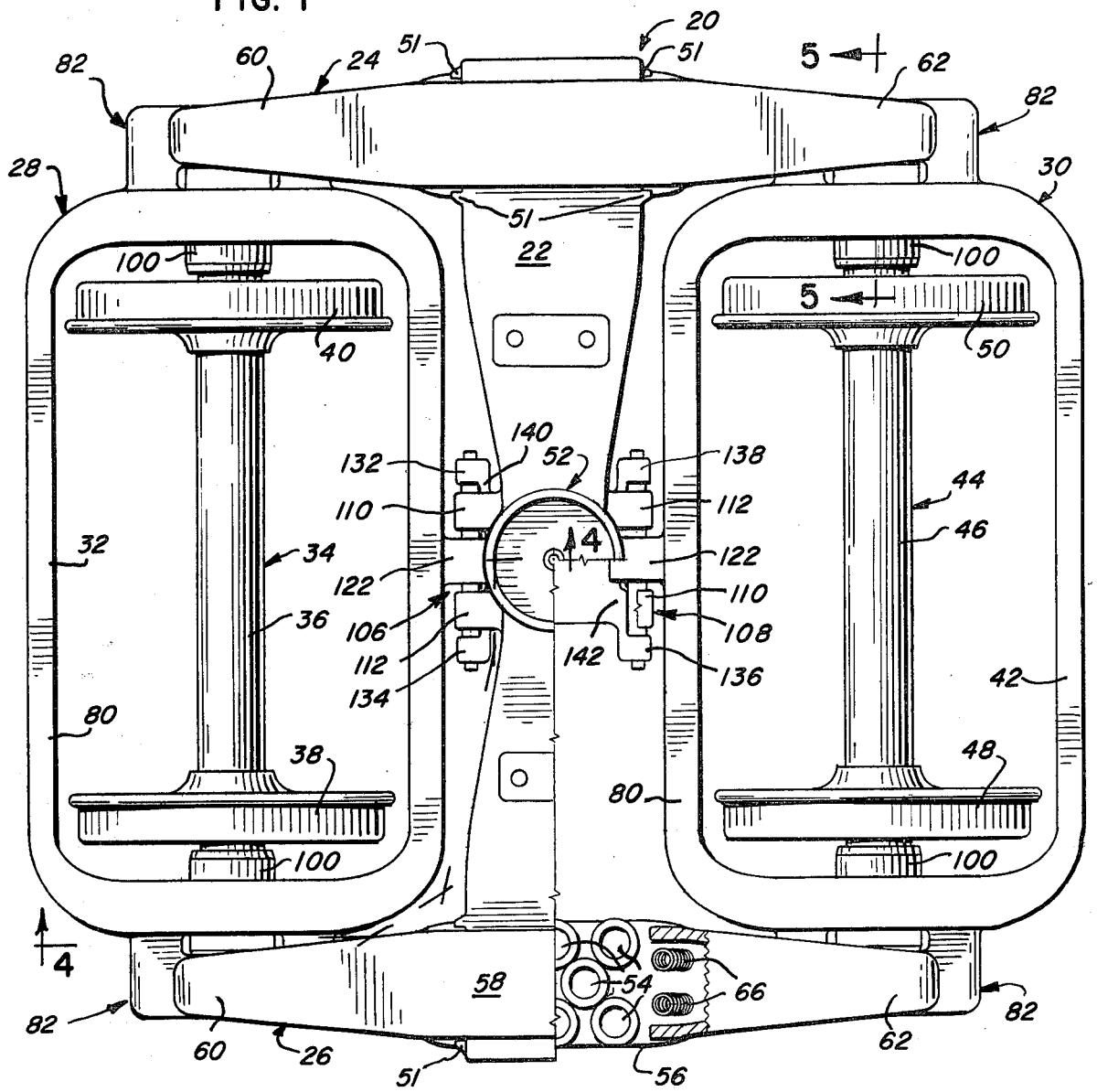

Referring now to the drawings, the truck assembly 20 illustrated in FIGS. 1–11 includes a transverse center support bolster 22, side frames 24 and 26, and two wheelset swiveling assemblies 28 and 30. The wheelset swiveling assembly 28 includes a wheel-holding frame 32 in which is journaled a wheelset 34 comprising an axle 36 to which is rigidly affixed a pair of conventional flange wheels 38 and 40. The wheelset swiveling assembly 30 similarly includes a wheel-holding frame 42, with a wheelset 44 comprising an axle 46 to which is rigidly affixed a pair of flange wheels 48 and 50. In several of the figures, the upper surface of a railroad rail is represented by a line labeled R.

The bolster 22 includes gib-like retainers or guides 51 on each side of the side frames, and is provided with a conventional center bearing structure at 52 for receiving the king pin and bearing plate of a railway car (not shown) to be supported on the truck assembly 20. The bolster is of a length somewhat greater than the length of a bolster in a conventional three-piece truck and is supported on the side frames 24 and 26 in the general manner of a conventional basic three-piece freight car truck assembly. Each end of the bolster is supported on a set of springs 54. The springs in turn are supported on the lower chord 56 of the respective side frame, see FIGS. 1 and 2.

The side frames 24 and 26 are of a truss design in which the center section includes the lower chord 56, and an upper chord 58, with oppositely extending end sections 60 and 62 for bearing support on the respective wheelset swiveling assemblies. Friction wedge blocks 64 are supported within pockets provided in the respective vertical struts or columns 65*a* and 65*b* of the side frame members, there being such a wedge block on each side of the bolster end within each side frame. Each wedge block 64 is urged upward by a pair of compression springs 66 supported on the lower chord section 56, with each wedge block having friction-bearing engagement with an adjacent wear plate 68 installed in the vertical side surface of the respective bolster end and being contained by an opposing wear surface 70 forming a part of the wedge block containing pocket which is a part of the respective side frame. These blocks maintain relatively constant fore-and-aft forces against the truck bolster, and the frictional engagement of the blocks with the bolster provides snubbing or damping action of bolster movement relative to the side frame both vertically and laterally (transverse to the tracks). The friction wedge block arrangement also tends to hold the side frames in a square or right-angular relationship with respect to the bolsters. The friction wedge block arrangement of truck assembly 20 is similar in overall configuration to wedge block systems employed in present stabilized three-piece truck designs. However, in truck assembly 20, extra width of the side frames accommodates a pocket of a width permitting the wedge blocks to be of considerably greater length (as measured transverse to the tracks) to provide an extra measure of the squaring effect between the side frames and bolster.

Figure 2:
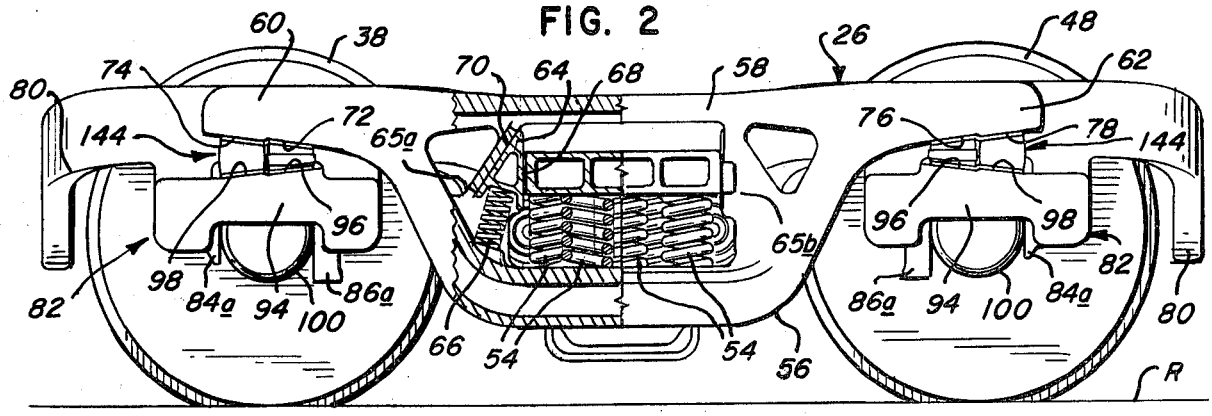
FIG. 2 is a side elevation view, partially in section, of the truck of FIG. 1.
Figure 3:
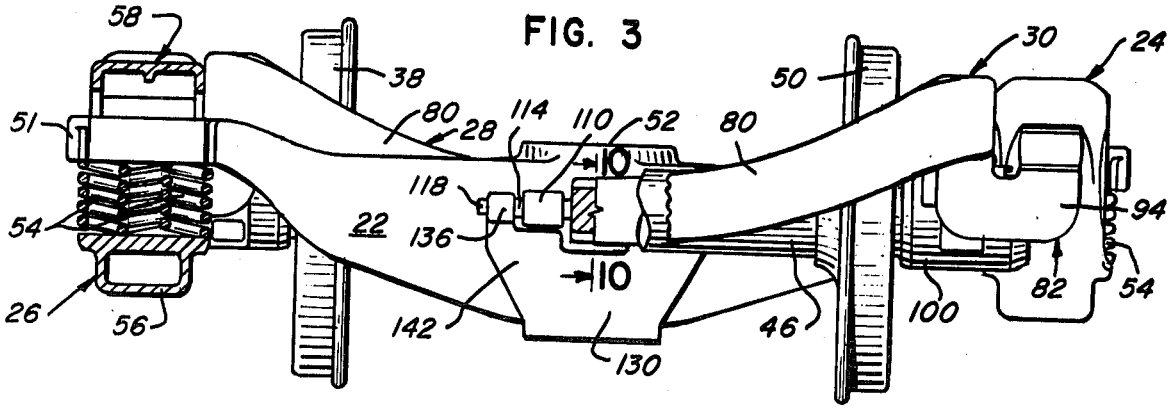
FIG. 3 is an end elevation view, partially in section, of the truck of FIG. 1.
Figure 6:
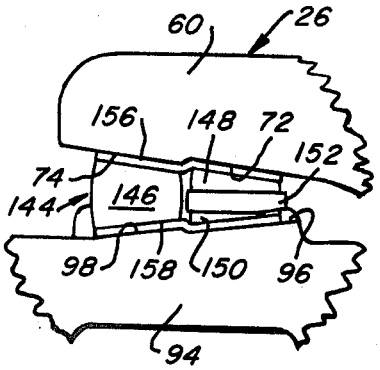
FIG. 6 is an enlarged side elevation view of the resilient mounting arrangement of the truck of FIG. 1.

The lower surface of each end section 60 and 62 of each side frame is of a configuration to provide a pair of planar bearing surfaces which are inclined upwardly from the horizontal in a direction away from the bolster, as seen at 72 and 74 and 76 and 78, respectively, in FIGS. 2 and 6.

Figure 4:
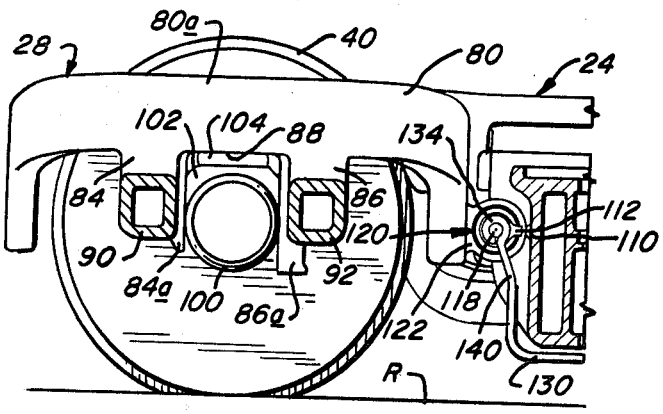
FIG. 4 is a partial elevation and partial section view of the truck of FIG. 1, taken generally along the irregular line 4—4 of FIG. 1.
Figure 8:
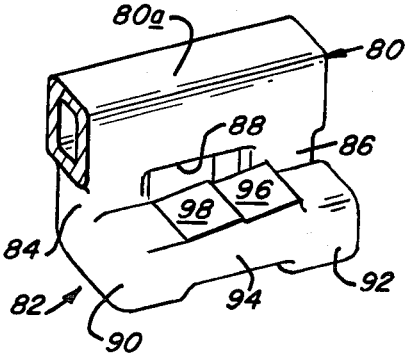
FIG. 8 is a perspective view of the support section of a wheel-holding frame of the truck of FIG. 1.

Referring further to the wheelset swiveling assemblies 28 and 30, each wheel-holding frame 32 and 42 comprises a unitary structure, preferably a casting, including a generally rectangular shaped main frame portion 80 with depending pedestal opening and load support structures 82 at each end. Referring particularly to FIGS. 4 and 8, each pedestal opening and load support structure 82 includes a pair of short pedestal arms 84 and 86 extending downwardly from a longitudinal end portion 80*a* of the frame member 80. Short support arms 90 and 92 extending horizontally outward from the pedestal arms 84 and 86 merge with a support bar 94. As shown in FIG. 8, each bar 94 is provided with a pair of planar upper support surfaces 96 and 98 which extend at a shallow angle of decline relative to the horizontal in a direction away from the bolster 22. As shown in FIG. 4, the pedestal arms 84 and 86, together with the intervening lower surface 88 of the frame portion 80*a* and pedestal arm extensions 84*a* and 86*a* form the pedestal opening.

Figure 5:
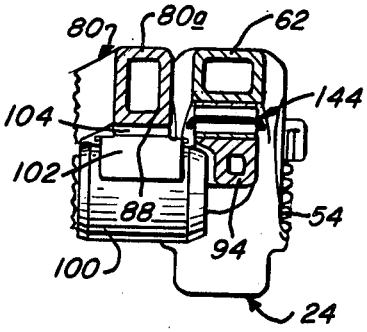
FIG. 5 is a partial elevation and partial section view of bearing and resilient mounting arrangements of the truck of FIG. 1, taken generally along line 5—5 of FIG. 1.

Referring now also to FIGS. 4 and 5, a bearing 100 is provided on each outer end of each axle 36 and 46. A bearing adaptor 102 rests on each of the bearings 100. The bearings 100 and adaptors 102 may be of conventional construction. In each of the wheelset assemblies, the bearing and adaptor components at each end of the axle of the wheelset are received in mating, longitudinally confined engagement within the pedestal opening of the pedestal and load support structure or bracket 82 at the respective side of the wheel-holding frame, as illustrated. An elastomeric pad 104 also is installed between each pedestal surface 88 of each wheel-holding frame and the respective bearing adaptor 102. The pad 104 provides vertical elastic cushioning between each wheel-holding frame and the respective wheelset, and allows for some elastic spring-type lateral movement between each wheelset and wheel-holding frame. The adaptor pads 104 may be of designs presently commercially produced for use in conventional three-piece trucks.

Figure 9:
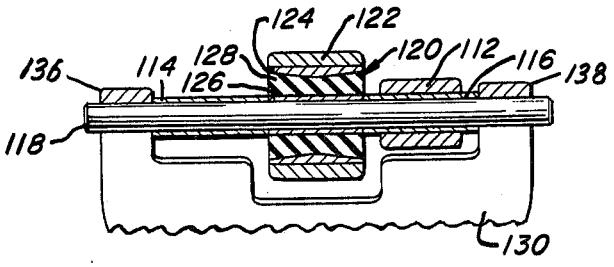
FIG. 9 is an enlarged elevation view, partially in section, of the pin connection assembly of the truck of FIG. 1, taken generally along the line 9—9 of FIG. 1.
Figure 10:
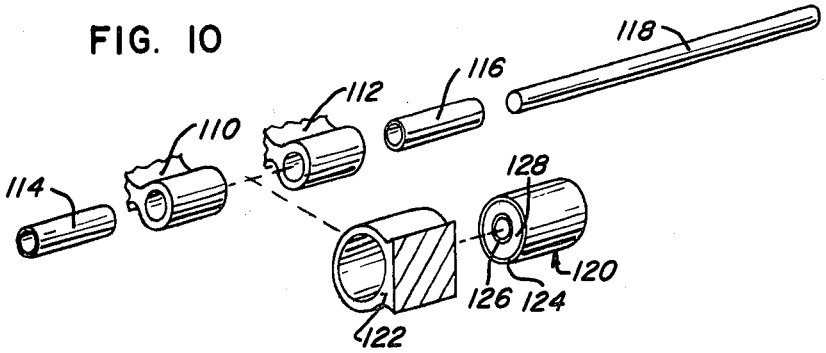
FIG. 10 is an enlarged exploded view of the pin connection assembly of the truck of FIG. 1.
Figure 11:
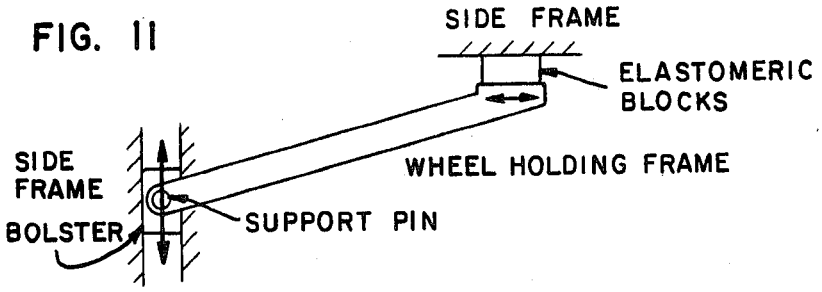
FIG. 11 is a kinematic bar representation of each wheel-holding frame installation in the truck of FIG. 1.

The wheelset swiveling assemblies 28 and 30 are pin connected to the bolster 22 through a pair of pin connection assemblies 106 and 108. As seen in FIGS. 1, 9 and 10, each pin connection assembly includes two support arms 110 and 112 integral with the bolster vertical side face, sleeve spacers 114 and 116 inserted in axially aligned openings through each support arm, respectively, a support pin 118 in turn inserted through the two sleeve spacers, a cylindrical subassembly 120 positioned between the pair of support arms and through which the pin is also inserted, and an extension 122 of the wheel-holding frame containing the subassembly 120, the extension being cast integrally with the wheel-holding frame. Each subassembly 120 is comprised of an outer sleeve 124, an inner sleeve 126 and an elastomeric sleeve separator element 128. As will be observed, the outer sleeve 124 and the elastomeric sleeve 128 have cooperating truncated conical wall surfaces producing radially increasing wall thicknesses of the elastomeric sleeve as measured in vertical cross sectional planes moving axially outward from a vertical midplane reference in the sleeve.

Each pair of support arms 110 and 112 may be cast onto the bolster side faces and is symmetrically located and spaced laterally on the bolster to provide a given lateral clearance between the wheel-holding frame extension 122 and each support arm on either side of the extension, assuming a centered position of the wheel-holding frame in the truck assembly. The inner sleeve 126 held within the extension is allowed an axial sliding movement along and an angular or rotational movement about the axis of the support pin 118. The pin connection assemblies thus far functionally described permit the wheel-holding frame extensions and thus the wheelset swiveling assemblies 28 and 30 two degrees of motion with respect to the bolster. Such are a lateral movement with respect to the bolster (and vice-versa) and a vertical pivoting movement about the bolster side face.

The radial compressive and expansive capacity of the wall of the elastomeric sleeve element 128 contained in each pin connection assembly allows limited relative angular movement between the cylindrical axes of the outer sleeve 124 and the support pin 118 in any directional orientation. Such relative angular movement permits two additional degrees of movement of each wheel-holding frame with respect to the bolster. The one degree of wheel-holding frame movement referred to is the horizontal swiveling movement of the wheel-holding frame involved in truck guidance. This movement causes limited relative angular movement between the cylindrical axes of the outer sleeve and the support pin in a generally horizontally oriented plane. The other degree of wheel-holding frame movement referred to is a limited relative rotative motion between the wheel-holding frame and bolster about a longitudinal (in the track direction) centerline axis passing through the bolster at the level of the pin connection. This movement results in limited relative angular movement between the cylindrical axes of the outer sleeve and the support pin in a generally vertically oriented plane. A relative rotating motion between the wheel-holding frame and the bolster about the before-mentioned longitudinal centerline axis can be created in either of two ways. One is by the relative vertical and load equalizing movement of the truck wheels in following vertical track irregularities, a topic more fully discussed at another point in this disclosure. The other is by a lateral rocking motion of the car body and truck bolster on the truck springs as might result from periodic low joint track input at low operating speeds. A somewhat higher degree of relative rotative motion might occur in this latter manner and the elastomeric sleeve element is specially designed to accommodate such motion without producing undue compressive stresses in the element or excessive binding forces on the support pin. The before noted increasing radial wall thicknesses of the elastomeric sleeve is able to better match in resilient compression and expansion an increasing radial relative movement between the outer sleeve and the support pin as measured in vertical cross sectional planes moving axially outward from a vertical midplane reference in the outer sleeve. Thus, with respect to certain motions of the wheelset swiveling assemblies relative to the bolster, the pin connection assemblies 28 and 30 act in the manner of universal ball and socket type connections.

The pin connection assemblies 106 and 108 between the wheel-holding frames and the bolster are also utilized for an interconnection between the wheel-holding frames on either side of the bolster. Such an interconnection is effected by a generally U-shaped connecting plate 130 seen in FIGS. 3 and 4. This plate spans the underside of the bolster and is supported on both sides of the bolster by the support pins 118 inserted through pairs of arms 132 and 134 and 136 and 138 on the plate ends 140 and 142, respectively, see FIG. 1. Each pair of arms abut against the sleeve spacers 114 and 116 which are close fitted between the arms and the inner sleeve 126 and which slide axially within the support arms 110 and 112, see FIGS. 3 and 9. Thus, assuming relative rigid behavior of the connecting plate, a given lateral (axial) movement of a respective inner sleeve 126 resulting from a laterial or horizontal swiveling movement of the wheel-holding frame on a given bolster side would be directly transmitted to the corresponding inner sleeve on the other bolster side (and vice-versa). In so transmitting a lateral movement from one inner sleeve to the other, the plate interconnection functions in the manner of a pivot point type connection in the center portion of the truck assembly between wheel-holding frames. The elastomeric sleeves 128 accommodate the relative angular motion in a generally horizontal plane of the kinematic linkage thus formed by the two wheel-holding frames and the connector plate 130.

With regard to the lateral motion transmitted by the interconnection, it should be noted that the elastomeric sleeve element 128 in each pin connection assembly 106 and 108 performs yet another function in addition to that involved in the support engagement of the wheel-holding frames to the bolster. That second function is the introduction into the interconnection of a degree of resilience to such lateral motion. A lateral movement of a given wheel-holding frame extension 122 exerting an axial shearing load between the outer and inner sleeves 124 and 126 in the connection subassembly 120 will produce an axial shearing deformation within the elastomeric element 128 and so an elastic axial displacement between the sleeves 124 and 126. A certain controlled stiffness is thus introduced into the interconnection for purposes other than the direct steering function and discussed again at another point in this disclosure.

The planar support surfaces 96 and 98 of the wheelset swiveling assembly 28 are positioned in subtending registry relative to the planar support surfaces 72 and 74 on the respective adjacent ends 60 of the side frames 24 and 26, while the corresponding support surfaces 96 and 98 of the wheelset swiveling assembly 30 are in similar sub-tending registry with respect to the planar support surfaces 76 and 78 on the respective adjacent ends 62 of the side frames 24 and 26. Moreover, as is seen particularly in FIGS. 2 and 6, each such pair of opposed planar support surfaces extend in diverging relationship to one another in a direction outwardly from the bolster 22.

Figure 7:
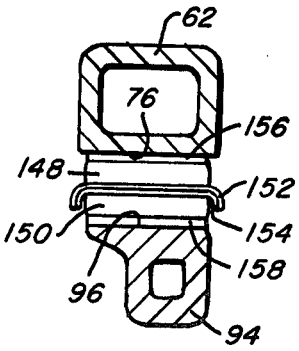
FIG. 7 is an enlarged view of a portion of FIG. 5.

A wedge-shaped elastomeric connector and mount assembly 144, as seen in FIGS. 6 and 7, is provided between the respective pairs of opposed support surfaces on the side frame and wheel-holding frame members at each of the four corner mounting positions of the truck. Each of these mount assemblies includes a wedge-shaped elastomeric block 146 and two wedge-shaped elastomeric blocks 148 and 150. The blocks 148 and 150 are arranged in an over and under combination, functioning in certain respects as a single block, but separated by the bearing plates 152 and 154. The block 146, which is located in an outer (away from the bolster) position relative to the combination of blocks 148 and 150, is attached, as by bonding, to an upper mounting plate 156 and to a lower mounting plate 158. The inner elastomeric block 148 located in upper position relative to the block 150 is similarly affixed to the upper plate 156, which forms a common upper mounting for both blocks 146 and 148. On its lower side, the block 148 is secured to the bearing plate 152 which interfaces with the bearing plate 154. The inner block 150 is in turn secured on its upper side to the bearing plate 154 and affixed on its lower side to the mounting plate 158, which forms a common lower mounting plate for both blocks 146 and 150. As particularly indicated by the FIG. 7, the bearing plate 154 secured to the lower block 150 includes side portions which turn downward partially enclosing but not restraining those two sides of the elastomeric block 150.

The bearing plate 152 secured to the upper block 148 includes side portions which turn downward and enclose and restrain laterally the corresponding side portions of the bearing plate 154. Thus, the respective bearing plates 152 and 154 of the blocks 148 and 150 form an interface permitting a relative sliding movement between the two plates in a fore-and-aft direction but preventing such movement in a lateral direction, i.e., making the two blocks 148 and 150 appear as one elastomeric block with respect to a lateral deformation of the block combination. The common lower mounting plate 158 is affixed to the support surfaces 96–98 of the respective support bar 94, while the upper mounting plate is affixed to the corresponding opposed support surfaces 72–74 and 76–78 of the respective side frame. Thus, the outer elastomeric blocks 146 at the four mounting positions adjacent the respective wheel bearings provide elastomeric connections between the wheelset assemblies and the side frames. Each outer elastomeric block 146 is of a height greater than that of the combined height of the two inner elastomeric blocks 148 and 150. Also, the individual configurations and sizes of the two blocks 148 and 150 are such that if these blocks were combined into a single block in the free state, the resulting block would have an overall size and configuration continuous with that of the wedge-shaped block 146 also in the free state, i.e., the two elastomeric blocks 148 and 150 and the elastomeric block 146 would appear to be contiguous sections of one original wedge-shaped block having uniplanar upper and lower surfaces.

Because the wheel-holding frames 32 and 42 are pin connected to the truck bolster 22 at levels which are fixed vertically relative to the bolster, vertical movement of the bolster such as occurs under different static and dynamic car loading conditions and attendant compression and extension of the springs 54 will move the pin connection assemblies 106 and 108 up and down. Since the vertical positioning of each wheel-holding frame is essentially constant in the vertical plane of the respective wheel axle, the vertical movement of the bolster will cause a vertical angular or rocking movement of each wheel-holding frame on the respective wheel axle. The different relative angular positions thus assumed by each wheel-holding frame will cause a corresponding change in the relative angular position between respective pairs of mounting surfaces on the side frames and wheel-holding frames receiving the side frame/wheel-holding frame mount assemblies. Increased loads will cause downward deflection of the bolster, which will result in a decrease in the included angle between the opposed surfaces, while lighter loading will result in an upward movement of the bolster and attendant increase in the included angle. By way of example, changing from a spring free to a light car loading may rotate the wheel-holding frame and thus the lower mount surfaces through an angle of about $\frac{3}{4}°$, while changing from a light car loading to a fully loaded car situation may cause an additional rotation of approximately 3°.

Changes in the included angle between opposed mounting surfaces on the side frame and wheel-holding frame members require different amounts of relative vertical movement of various portions of the opposed surfaces toward and away from one another due to the differences in radial distance from the support pins 118 to the respective portions of the surfaces. The elastomeric blocks or block combinations within the mount assemblies 144 are of tapered end or truncated wedge configurations, preferably corresponding in longitudinal section in the free state to the angle formed between the opposed mounting surfaces under the truck spring free loading condition. Due to this tapered configuration of the blocks, greater thickness of the elastomeric material are provided between the opposed surfaces having the greater amounts of relative movement toward and away from one another, thereby maintaining a relatively uniform vertical compression stress distribution throughout the elastomeric blocks and over the respective opposed support surfaces through the entire range of design truck loading, e.g., from "spring free" or no load to total compression or "spring solid" load condition. It will be appreciated that under normal free swiveling operating conditions, the mount assemblies 144 are located in approximately symmetrical positions over and adjacent the respective wheel bearings, i.e., each mount assembly is oriented and located in a relatively level and centered position over the axis of the respective axle. As a result, a relatively balanced or uniform loading will be maintained on each mounting bracket of the wheel-holding frames over the entire design load range of the truck. The pin connections between the wheel-holding frames and bolster therefore need be designed to withstand essentially only those forces or loadings exerted by the wheel-holding frames under conditions of wheel braking, car coupling impact, and wheelholding frame swiveling movement.

As will be observed, the average elevation of the mount support surfaces on a wheel-holding frame is above that of the wheel-holding frame to bolster pin connection for all truck loading and bolster height positions. According to the FIG. 11, an up and down movement of the bolster as occurs under different static and dynamic car loading conditions will also result in some fore-and-aft movement of the mount support surfaces on the wheel-holding frames relative to the overlying surfaces on the side frames. The mount assemblies 144 will accommodate this relative movement by horizontal shear deformation within the outer elastomeric blocks 146 and to some extent by similar shearing deformation within the blocks 148 and 150 as well as by sliding displacement of the bearing plates 152 relative to the bearing plates 154. Without going into unnecessary detail, it will be noted that the overall effect of such horizontal shear deformation existing in the mount assemblies, particularly within the elastomeric blocks 146, is an increase in the yaw stiffness of the truck. Depending upon the kinematic bar length of the wheel-holding frames as effecting the longitudinal positioning of the mount support surfaces on the wheel-holding frames relative to that on the side frames, the state of zero longitudinal shear deformation in the mount assemblies can be made to occur at any particular truck load level. Adjusting this length as by the dimensioning of the wheel-holding frames when cast, the state of zero longitudinal shear deformation can be made to occur at the light car load level. Thus the longitudinal shear deformation of the mounts would increase with increasing truck loading. The wheel/rail forces available for producing wheelset swiveling on a given track curve also increase with increasing truck loading. A mechanism is thus incorporated to vary the yaw stiffness of the truck with the wheelset swiveling moments as effected by car loading.

In the truck 20 the relative fore-and-aft movement of the axle ends required for truck steering is permitted by the resilience of the mount assemblies 144. Since the elastomeric blocks 146 of the mount assemblies are joined to both the respective side frame and wheel-holding frame, these blocks provide elastic restraint between these joined members in a horizontal plane, i.e., both longitudinally and laterally of the truck assembly. The inner blocks 148 and 150 also provide a degree of similar resilient restraint between the side frame and wheel-holding frame, particularly in the truck lateral direction, but limited in the longitudinal (fore-and-aft) direction because of the limits of the frictional sliding restraint between the bearing plates 152 and 154. Beyond those limits, a sliding displacement occurs between the plates. The frictional resistance between the plates can essentially be eliminated, e,g., as by lubrication, in which case the function of the inner mount assembly with respect to relative fore-and-aft displacement between the side frame and wheel-holding frame becomes that of an elastomeric support only, assuming an approximate horizontal orientation of the interface between the bearing plates. The combination of the longitudinal restraint of the four mount assemblies 144 associated with the two wheel-holding frames largely determines the yaw stiffness of the truck affecting the overall wheelset swiveling movement. Accordingly, reduction of the longitudinal restraint, as by use of the sliding plates, reduces the yaw stiffness effect of the mounts. Lateral stiffness of the truck is determined by the combination of the lateral restraint of the four mount assemblies plus the lateral stiffness of the mid-truck connection.

A preferred orientation of the wedge-shaped elastomeric mount assemblies 144 is such that under the fully loaded car situation, the included angles formed by the respective pairs of upper and lower mounting plates 156 and 158 and thus that of the corresponding opposed mount surfaces on the side frame and wheel-holding frame members are equally divided about the horizontal. Such is shown with an exact horizontal orientation of the interface formed between the bearing plates 152 and 154. By way of specific example, using an exemplary wedge block angle of $17\frac{3}{4}°$ for both the outer blocks 146 and the combination of inner blocks 148 and 150 in the free state and the wheel-holding frame movement parameters noted before, the included angle of the respective mount assemblies becomes 14° for the fully loaded car condition (a $3\frac{3}{4}°$ total tilting rotation of the wheel-holding frames for the truck undergoing a load change from the spring free to the fully loaded car condition). Equally dividing this angle about the horizontal, the respective upper and lower mounting surfaces would be at an angle of 7° to the horizontal. Upon release of the truck loading and the concomitant rotation of the wheel-holding frames, the mounting surfaces on the wheel-holding frames would assume an angle of 10° and $10\frac{3}{4}°$ with respect to the horizontal for the light car and the "spring free" loading conditions respectfully.

Swiveling restraints such as side bearings (not shown) and other known accessory components may be provided on the truck assembly disclosed herein, as desired.

A number of improved performance objectives are attainable with the truck assembly 20. These include improved curve tracking ability, control of wheel hunting motion, improved vertical and lateral ride quality, wheel load equalizing ability, convenience and simplicity of brake component mounting, simplicity and economy of construction, and relatively low operation and maintenance costs. By way of explanation of the truck's curving performance, when a loaded truck 20 enters a track curve, a lateral inward flange or flange fillet force will be generated between the leading outer wheel and the rail. This primary force along with other force reactions developed on the other truck wheels form a turning couple acting on the lead wheelset and against the yaw restraint of the truck and the swiveling resistance of the truck frame (specifically the bolster) relative to the supported car body. Because of the aforementioned fore-and-aft resilience afforded by the side frame/-wheel-holding frame connections, some curve inward swiveling movement of the leading wheelset will occur accompanied by some corresponding movement of the trailing wheelset. The resulting yaw angles assumed by the respective wheelsets with respect to the truck frame will act to further increase the turning couple, tending to swivel the truck frame relative to the car body and so on. Further entry of the truck into a curve of substantial curvature will result in a further increase in the turning couples developed on the wheelsets and thus a further swiveling of the wheelsets, and finally swiveling of the truck bolster as the noted turning resistances are overcome. Once the truck is fully into the curve, the two wheelsets will remain in a relatively fixed turning and thus truck guiding relationship with respect to one another. Because of the relative angular displacement beween the wheel-holding frames and the truck frame, the before suggested shear deformation will exist in the resilient blocks of the respective mount assemblies 144 providing restoring forces which will tend to return the wheelsets to their normal square or straight ahead parallel positions as soon as the turning moments are removed as the truck exits from the curve onto straight track.

Explanation should be made as to the purpose of the resilience and attendant controlled stiffness incorporated in the midtruck connection between wheel-holding frames which permits a degree of relative lateral motion between the wheel-holding frames' inner ends. The purpose of this relative lateral motion between the wheelsets is two-fold. One is to prevent the buildup of extremely high forces in the steering mechanism when the truck is negotiating an extremely sharp track curve and the steering mechanism would otherwise attempt to equally divide the steering moments and yaw angles between the two truck axles. The other purpose is that of permitting a degree of relative lateral motion between wheelsets helpful in allowing the wheelsets to individually follow lateral track irregularities at high operating speeds. The resilience of the midtruck wheelset interconnection permits a slight deviation in the relative yaw motion between wheelsets from that of an exact opposed horizontal swiveling motion, which enhances the wheelset hunting control provided by the pivotal type interconnection between wheelsets.

With further regard to relative lateral movement between wheelsets, it should be noted that the wheel/-rail forces producing wheelset swiveling movement also tend to produce a relative lateral movement between wheelsets. Such lateral movement, however, would subtract from the desired steering movements. The steering function alone therefore would dictate a rather high lateral stiffness in the side frame to wheel-holding frame mount assemblies 144. Another design goal of the truck, however, is good lateral ride quality which would be reduced by such a high lateral stiffness. Therefore, the design of the mount assemblies 144 requires some compromise in the longitudinal and lateral restraints as regards the truck steering and the lateral ride cushioning functions, the latter a topic discussed at another point in this disclosure.

As will be appreciated by those skilled in this art, the various angular displacements referred to in discussing the operation of the truck unit 20 are relatively small angular values in normal operation situations. At the same time, accomplishing the relative angular movements between the components to accommodate these changes are very important to desirable operation of a railway car truck assembly.

The same mechanism permitting truck steering also provides for the control of wheelset hunting motion inherent in the use of "coned" wheels. Such is the degree of yaw motion between wheelsets controlled by the smooth spring elastic restraint of the side frame/-wheel-holding frame mount assemblies 144, as further affected by the resilience of the midtruck connection referred to above. This motion permits the mechanism of creep damping between the wheel treads and the rail, a recognized means of limiting wheel hunting oscillations up to high operating speeds.

With reference to ride quality, in effect the resilient mount assemblies 144 become a primary suspension system, with the conventional truck springs 54 becoming a secondary suspension system. Since the side frames rest on the resilient mount assemblies 144, the unsprung mass is reduced, as compared to a conventional three-piece truck. The unsprung truck mass is further reduced by the interposition of the pads 104 between the wheel-holding frames and the bearing adaptors. Cushioning at this point is also effective toward absorbing the higher frequency, low amplitude shock and vibratory-type motion generated by the engagement of the wheel with the rail. The elastomeric non-linear spring rate characteristic of both of these sets of mounts 104 and 144 tends to present a softer, longer travel type of spring rate suspension to the supported railway car under lightly loaded conditions than would pertain with a conventional linear spring rate type of truck spring. Another advantage of the double suspension system is the effectiveness of two different spring and damping systems in reducing the transmissibility of different ranges of shock and vibratory input forces and motion. Also, of course, the wedge block snubbers 64 and related components tend to prevent a resonant buildup of vertical harmonic car motion as is often produced at higher train operating speeds by periodic type track input. As noted briefly above, the extra length of the wedge blocks 64 permitted by this assembly will also facilitate holding the truck bolster and side frame assembly in the maximum tram (squared) relationship, counteracting any parallelogramming tendency produced by wheel/rail contact or wheel-holding frame swiveling action on curves.

As with vertical ride quality, lateral ride quality of the truck benefits from the form of primary and secondary suspension systems presented by the sets of resilient mount assemblies 144 and the main truck springs 54. With particular reference to the side frame/wheel-holding frame mounting, the wheel-holding frames are allowed a degree of individual lateral movement with respect to the truck frame, dependent on the lateral stiffness of the mount assemblies 144 and the resilience of the midtruck connection of the wheel-holding frames to relative lateral motion between wheel-holding frames. Such permitted lateral motion of the wheel-holding frames allows the wheelsets to deflect with many lateral track irregularities accompanied by a reduction in the transmissibility of the wheelset motion to the car body. Truck lateral ride quality is also affected by wheel hunting motion and the ability of the described truck design to control such motion is pointed out before. In the event of limited wheel hunting motion occurring at extra high operating speeds, the wheel bearing adapter pads 104 will accommodate this motion while transmitting only a portion to the truck frame and car body.

The wide spacing of the side frames obtained in placing the side frames outboard of the wheel bearings provides a relatively wide spring base which enhances lateral roll stability of the car body by reducing the leverage effect of the car body on the truck spring system. This wide spacing also increases the relative motion between the truck bolster and the side frame wedge blocks 64, thereby enhancing the Coulomb damping effect of these blocks attendant upon any tendency to lateral harmonic roll motion of the car as is often produced by periodic type track input motion at certain lower critical car operating speeds. The bolster 22 is of generally conventional basic construction, except for the noted features.

While accomplishing the various other noted benefits, the described truck assembly 20 retains the characteristic of good wheel load equalizing ability normally associated with conventional three-piece truck designs. The rocking ability of the side frames with respect to the truck bolster to permit an individual wheel to rise and fall in accordance with the vertical track irregularities is maintained through the pin connections of the wheel assemblies to the bolster, such connections involving elastomeric construction functioning in certain respects as restrained universal ball and socket-type connections. Moreover, since the wheel-holding frame members are attached to and move with the individual wheelsets, except for the small degree of movement afforded by the pads 104, the wheel-holding frames provide excellent bases for mounting brake equipment (not shown), thus permitting a truck mounted braking system which will not interfere with the steering or spring cushioning functions of the truck.

The truck assembly 20 further possesses advantages of simplicity and economy. In each instance, a bolster and two side frame members are used, similar to conventional three-piece trucks, and as such incorporate most of the economical construction features which have been developed over the years for trucks of such designs. The wheel-holding frame members may be one-piece castings, including such components as the wheel-bearing pedestals and pedestal arms as well as the wheel-holding frame extensions forming part of the pinned connection to the bolster. The mount assemblies 144 and the subassemblies 120 of the pin connection assemblies 106 and 108 may be produced as separate units for easy and economical replacement of the assemblies within the truck assembly. The wheelset assemblies may be of conventional design, with standard bearings and bearing adaptor assemblies. Standard long travel springs as specified by the Association of American Railroads also may be utilized for springs 54, while other components such as the elastomeric bearing adaptor pads 104 may be components which are now produced commercially for standard types of trucks.

The various design features provided by the described truck assembly also contribute to low operation and maintenance costs. By way of one specific example, improved truck steering performance will increase the service life of the wheels, thereby reducing wheel dressing and replacement costs.

Referring now to FIGS. 12–21, the truck assembly 220 shown in those figures also is an articulated freight car truck and provides most of the advantages of the truck 20. In addition, the assembly 220 provides two other potentially advantageous features by way of a truck frame configuration more similar to that of the existing conventional freight car truck and fitting within the underframe spacing of all or at least most existing freight cars, and a supportive connection of the wheel-holding frame members to a fourth truck frame member in place of a similar connection to the truck bolster. The manner of attachment and restraint of the wheelset swiveling assemblies within the truck frame assembly is similar to that of the truck 20 and the basic principles of operation are the same. However, the assembly 220 generally uses a somewhat more elaborate and complex form of truck frame construction.

Truck 220 comprises a transverse center support bolster 222, a transom 223, two unitary side frame members 224 and 226, and two wheelset swiveling assemblies 228 and 230. The assembly 228 includes a wheel-holding frame 232 in which is journaled a wheelset 234 comprising an axle 236 to which are fixed wheels 238 and 240 and assembly 230 includes a wheel-holding frame 242 in which is journaled a wheelset 244 comprising an axle 246 with wheels 248 and 250 affixed in the same general manner as in truck 20. The bolster 222 includes a conventional center bearing structure 252, and the side frames include end sections 260 and 262 extending for bearing support on the respective wheelset swiveling assemblies, also in the same general manner as in truck 20. The bolster 222 and transom 223 form a transverse center support in a form sometimes referred to herein as a bolster/transom assembly, with the bolster and related springs 254 contained and supported within the transom member.

Figure 13:
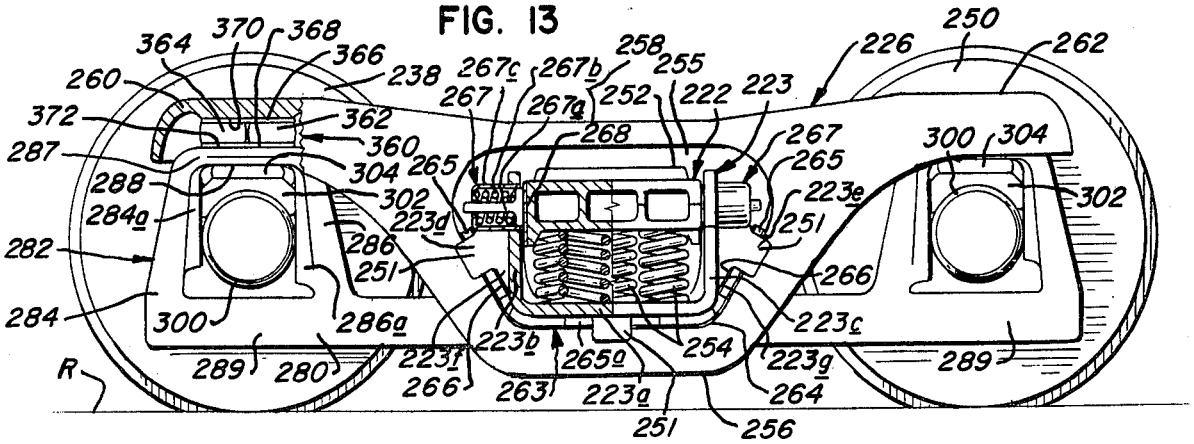
Figure 17:
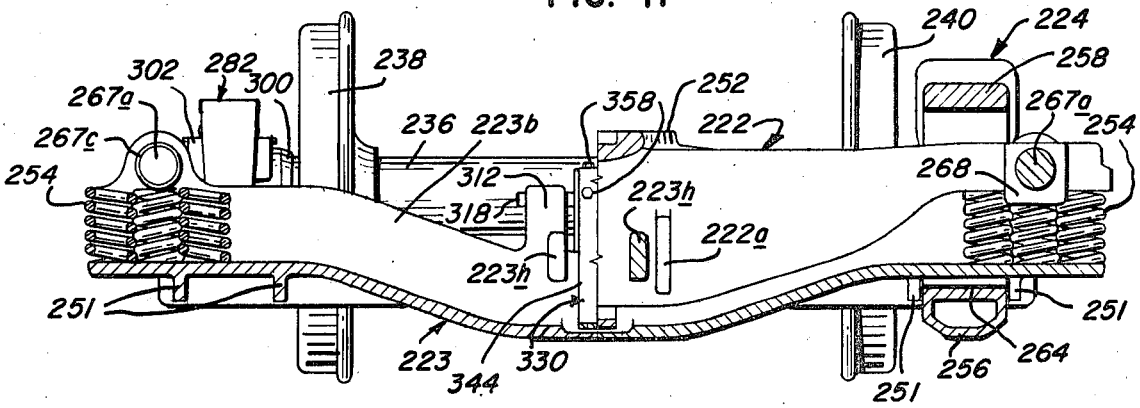
FIG. 17 is a partial elevation and partial section view of the truck of FIG. 12, taken generally along the irregular line 17—17 of FIG. 12.

Referring particularly to FIGS. 13 and 17, the transom 223 is a generally channel-shaped member having a bottom web **223*a* and side flanges 223*b* and 223*c*, and is supported by its ends being held or cradled within bolster/transom openings 255 provided in the generally truss-shaped side frame members 224 and 226, between chords 256 and 258. Near each end, the transom 223 includes a flat lower surface of web 223*a* and two opposite side extensions 223*d* and 223*e* having outer angularly extending support surfaces 223*f* and 223*g*, e.g., at opposite angles of inclination of about 60 degrees to the horizontal. Each such set of end support surfaces on the transom is received by an elastomeric pad assembly 263 interposed between the noted end support surfaces of the transom and the adjacent generally parallel support surfaces of the respective side frame as shown. Each pad assembly 263 is composed of a continuous connecting plate 264, two elastomeric pads 265 sandwiched and bonded between two side bearing plates 266 and the connecting plate 264 on the inclined portions of the plate, and a third elastomeric pad 265***a* bonded to the bottom middle portion of the connecting plate 264. Each such elastomeric pad assembly is installed in the bolster/transom opening 255 of the respective side frame member 224–226 with the plate 264 mounted on the side frame support surfaces, and with the side plates 266 receiving the two inclined mount surfaces 223*f* and 223*g* and pad 265*a* receiving the flat lower mounting surface of web 223*a* of the transom member. This inclined support surface arrangement will tend to hold the truck frame in a square or trammed configuration, and the elastomeric pads 265 and 265*a* will accommodate relative rocking motion of the side frames for vertical wheel load equalizing movement.

Spring-loaded friction plate and stem units 267 are mounted in the vertical wall portions 223*b* and 223*c* of the transom member. Each unit 267 comprises a plate and stem member 267*a* and a compression spring 267*b* within a housing 267*c* which is installed within the transom member. Such units are available commercially and have been used for "stabilizing" older unstabilized conventional trucks. The plate portions of members 267*a* bear on wear plates 268 installed on the sides of truck bolster ends as shown. An opposed pair of such plate and stem units 267 as installed maintain a relatively constant normal force between the plates 267*a* and the truck bolster for assistance in snubbing or damping vertical and lateral truck spring movement of the bolster relative to the transom.

Gib-like extension 251 on the inclined and flat bottom portions of the transom member straddle and restrict the side frames in a given laterally spaced relationship with relation to the bolster/transom assembly. Referring to FIG. 17, pairs of opposed inwardly extending ribs 223*h* are cast on the vertical wall portions or flanges 223*b* and 223*c* of the transom 223, about a midpoint position. Each of these pairs of ribs 223*h* extend between a pair of corresponding parallel vertical ribs 222*a* cast onto the adjacent vertical side face portion of the bolster 222. The ribs 222*a* restrict the lateral motion of the bolster relative to the transom resulting from truck spring lateral deflection.

Figure 12:
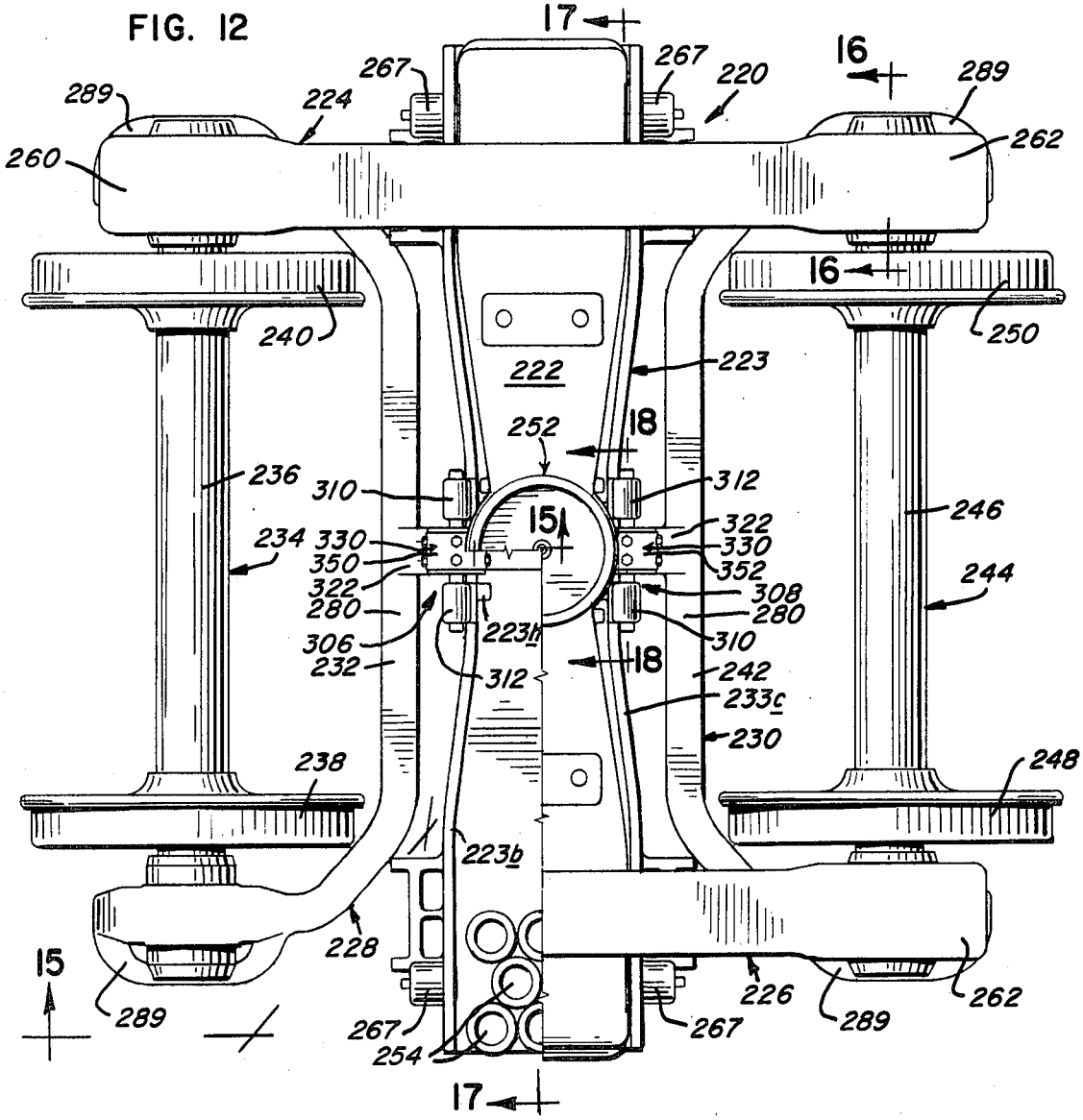
FIGS. 12, 13, 14, 15 and 16 are views corresponding generally to FIGS. 1, 2, 3, 4 and 5, respectively, illustrating another embodiment of a railway truck employing teachings of this invention.

The length of the truck bolster 222 is extended beyond that of the conventional three-piece truck and a wider spring base is obtained by use of the transom member 223. As best seen in FIGS. 12 and 17, the main truck spring sets 254 are positioned outboard of the center lines of the side frames.

Figure 15:
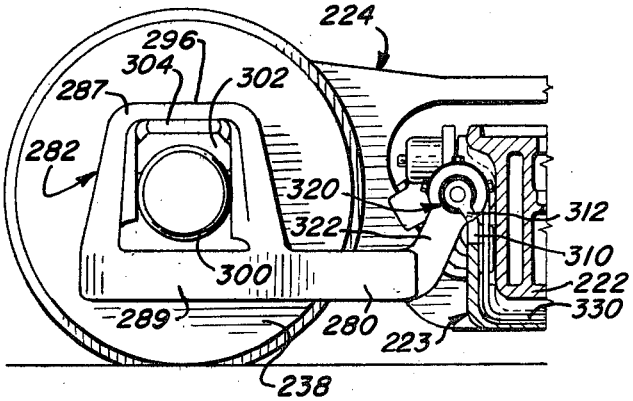

Each wheel-holding frame 232 and 242 includes a yoke or C-shaped main frame section 280 with a saddle and pedestal opening portion 282 at each end for engaging the respective wheelsets and side frame supports. As shown in FIGS. 13 and 15, each saddle portion 282 includes two vertical sections 284 and 286 and a top section 287. A pedestal surface 288 on the underside of each top section 287 along with pedestal arm extensions 284*a* and 286*a* on the respective vertical sections 284 and 286 form a wheel-bearing pedestal opening for receiving and engaging a wheel-bearing 300 with a bearing adaptor 302 and an elastomeric pad 304. A horizontal side bar section 289 joins the lower ends of each pair of sections 284 and 286 to strengthen the saddle and pedestal opening portion 282.

Each wheel-holding frame 232 and 242 is attached within the four-piece side frame and bolster/transom truck assembly in a manner to permit horizontal swiveling movement of the wheelset swiveling assemblies 228 and 230 within the truck frame and vertical pivoting movement of the assemblies 228 and 230 about pin connections at midpoint positions on the respective sides 223*b* and 223*c* of the transom member.

Figure 14:
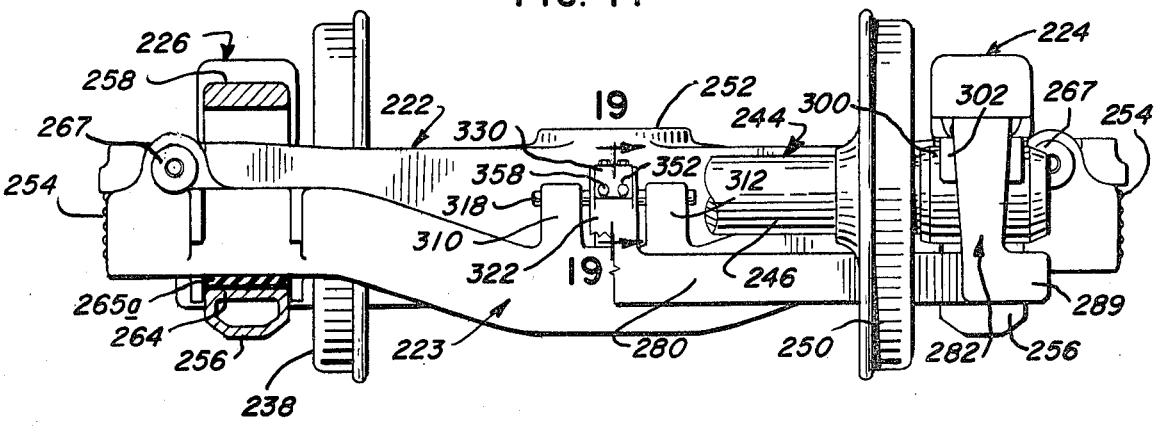
Figure 18:
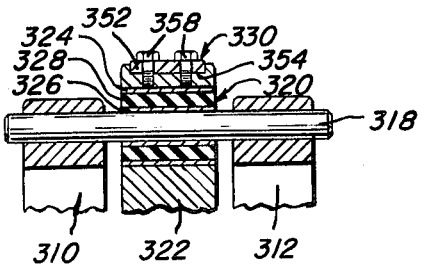
FIG. 18 is an enlarged sectional view of the pin connection assembly of the truck of FIG. 12, taken generally along line 18—18 of FIG. 12.
Figure 19:
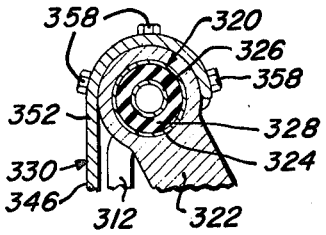
FIG. 19 is an enlarged sectional view, of the pin connection assembly of the truck of FIG. 12, taken generally along line 19—19 of FIG. 14.

Two horizontally oriented pin connection assemblies 306 and 308 form the supportive engagement between the respective wheel-holding frames and the transom member of the bolster/transom assembly, the parts of these connection assemblies being similar to certain parts of the pin connection assemblies 106 and 108 of the truck assembly 20. As shown in FIGS. 14, 18 and 19, each of the connection assemblies 306 and 308 include two support arms 310 and 312 integral with the respective transom side flange, a support pin 318 inserted through both support arms 310 and 312, a subassembly 320 positioned between the pair of support arms and through which the support pin 318 is also inserted, and a wheel-holding frame extension 322 having a cylindrical opening containing the subassembly 320, the extension 322 being integral with the wheel-holding frame. Each subassembly 320 comprises an outer sleeve 324, an inner sleeve 326 and an elastomeric sleeve separator element 328, all being of uniform wall thickness.

The pairs of respective support arms 310 and 312 on the transom side flanges are symmetrically located and spaced laterally on the respective transom side flange to provide a given lateral clearance between the wheel-holding frame extension 322 and the support arms on either side of the extension, assuming a centered position of the wheel-holding frame in the truck assembly. The inner sleeve 326 held within the subassembly 320 is allowed an axial movement along and an angular or rotational movement about the axis of the support pin 318. The pin connection assemblies thus far functionally described permit the wheel-holding frame extensions and thus the wheelset swiveling assemblies 228 and 230 two degrees of motion with respect to the bolster/transom assembly. Such are a lateral movement with respect to the transom (and vice-versa) and a vertical pivoting movement relative to the transom side flange.

As with the elastomeric element 128 in the pin connection assemblies 106 and 108 of the truck 20, introducing the elastomeric sleeve element 328 into each pin connection assembly permits two additional degrees of movement of each wheel-holding frame with respect to the bolster/transom assembly. The one degree of wheel-holding frame movement referred to is the horizontal swiveling movement of the wheel-holding frame involved in truck guidance. This movement causes limited relative angular movement between the cylindrical axes of the outer sleeve 324 and the support pin in a horizontally oriented plane. The other degree of wheel-holding frame movement referred to is a limited relative rotative motion between the wheel-holding frame and transom about a longitudinal (in the track direction) centerline axis passing through the transom at a level of the pin connection. This latter movement can be created by the relative vertical and load equalizing movement of the truck wheels in following vertical track irregularities, a topic previously discussed in this disclosure. This relative motion would result in limited relative angular movement between the cylindrical axes of the outer sleeve and support pin in a vertically oriented plane. Design of the pin connection assemblies in truck 220 need not be concerned with the possible lateral rocking motion of the car body and truck bolster on the truck springs as the wheel-holding frames are pin connected to a side frame mounted transom member, not to the bolster. Thus, with respect to certain motions of the wheelset swiveling assemblies relative to the transom, the pin connection assemblies 306 and 308 act in the manner of resiliently restrained universal ball and socket-type connections.

Figure 20:
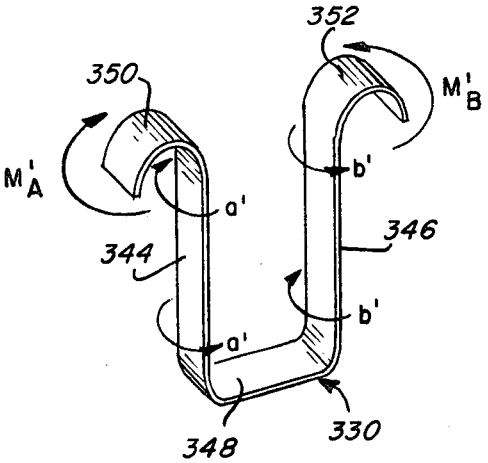
FIGS. 20 and 21 are engineering free body diagrams showing the moment and force systems applied to the connecting band of the truck of FIG. 12, in transmitting a lateral or swiveling movement between the wheel-holding frames.
Figure 21:
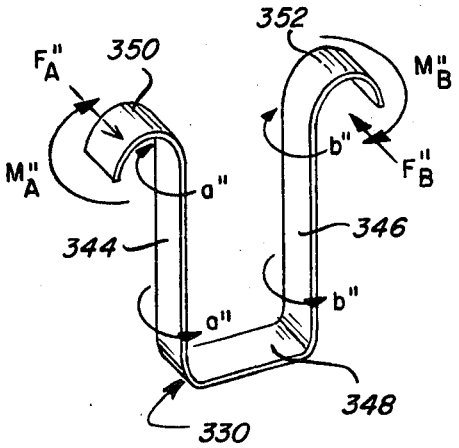

The wheel-holding frame extensions are also utilized to mount an interconnection of the wheel-holding frames on either side of the bolster/transom assembly. Such an interconnection is effected by the generally U-shaped connecting band or element 330 seen in FIG. 15 to extend downward alongside and under the bolster and to be supported and fastened to the respective wheel-holding frame extensions 322. As depicted by FIGS. 20 and 21, the connecting band 330 is composed of two vertical legs 344 and 346 connected by a horizontal leg 348. Two upper end portions 350 and 352 of the connecting band 330 are formed into curved semicircular segments fitting into corresponding cylindrical shaped grooves 354 formed into the respective wheel-holding frame extensions 322 as shown in FIGS. 18 and 19. The connecting band upper end portions 350 and 352 are fastened as by bolts 358 to the respective wheel-holding frame extensions. This fastening along with a fitting of the connecting band curved upper end portions into the aforementioned grooves provide rigid connections of the connecting band to the respective wheel-holding frame extension. The connecting band 330 may be fabricated from spring steel.

In transmitting a horizontal swiveling movement from one wheel-holding frame to the other, the connecting band 330 will undergo deflections that are the result of two different moment or force systems acting on the element. These two moment or force systems are, in turn, the result of the two different forms of resistance presented to the relative yaw motion between wheel-holding frames. The one form of resistance is the stiffness presented by the connecting band itself to a relative yaw movement between its upper end portions. The other form of resistance referred to is the swiveling restraint presented by the receiving wheel-holding frame due to the resilient connections of the wheel-holding frames to the side frames. For purpose of analysis of the functioning of the connecting band in transmitting a swiveling movement from one wheel-holding frame to the other, the two different moment or force systems acting on the band are best resolved and applied separately to the band as allowed by the linearity of the mechanics involved. The two different moment or force systems acting on the connecting band are shown by the FIGS. 20 and 21 which are free body diagrams of the band with the respective moment or force systems applied.

FIG. 20 shows a system of equal and opposite bending moments labelled $M'_A$ and $M'_B$ applied to the upper end portions of the connecting band as required to overcome the yaw stiffness of the connecting band, assuming no swiveling restraint of the individual wheel-holding frames (or wheelset swiveling assemblies). The horizontal leg segment 348 of the connecting band as oriented would appear relatively stiff to this applied loading. Therefore, the deflection of the connecting band required to accommodate the relative angular movement between wheel-holding frames will occur largely as equal and opposite torsional deflections in the respective vertical legs of the connecting band. Such torsional deflections are indicated by the respective pairs of arrows labelled a'—a' and b'—b'. In undergoing such deflection, the connecting band functions in the manner of a pivot point type connection between wheel-holding frames in the center portion of the truck assembly. The combined torsional stiffness of the vertical legs determines a yaw stiffness of the interconnection which adds to the overall yaw stiffness of the truck assembly presented to that wheelset motion. Accordingly, the yaw stiffness of the interconnection will assume increased significance wherever the other yaw stiffness factors are reduced, e.g., when using sliding plates such as at 152—154.

FIG. 21 shows the system of equal and opposite lateral force reactions labelled $F_A''$ and $F_B''$ applied to the respective upper end portions of the connecting band as involved in transmitting a swiveling moment from one wheel-holding frame to the other. The forces shown result from wheelset swiveling motion in the same direction as that which results in the moments seen in FIG. 20. As seen, the equal and opposite force reactions form a couple which must be balanced for static equilibrium of the connecting band. Moments opposing this turning couple are developed on the respective upper end portions of the connecting band by the wheel-holding frames and are labelled as $M_A''$ and $M_B''$. The result of applying the force system depicted in FIG. 21 to the connecting band is again equal torsional deflection occurring in the vertical legs but in the same relative rotative direction as for the moment system, as indicated by the respective pairs of arrows labelled a''—a'' and b''—b''. Here the combined torsional stiffness of the vertical legs along with the length of the horizontal leg determine the degree of lateral stiffness of the interconnection to relative lateral motion between wheel-holding frames.

Thus, as with the interconnection in truck 20, the overall functioning of the steel band mechanism in truck 220 is that of a direct pivot type connection between wheel-holding frames but with a degree of resilience to relative lateral movement between wheel-holding frames introduced therein.

It should be noted that in providing a continuous connection between wheel-holding frames, the connecting band is also required to accommodate the relative rotative motion between wheelset swiveling assemblies as produced by vertical wheel load equalizing movement. That capability is provided by the horizontal leg segment 348 being of sufficient length and undergoing a torsional deflection to accommodate this motion, the vertical leg segments in this case appearing relatively stiff to the motion involved. Therefore, the connecting band is seen to incorporate the mechanisms to accommodate three different degrees of motion between wheel-holding frames or wheelsets. Some compromises in the stiffnesses of the connecting band with respect to these different motions are required. Proper choice of the spring steel material and sizing of the band provides the adjustments required.

Figure 16:
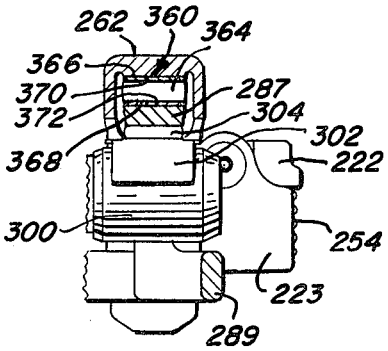

Elastomeric mount assemblies 360 provide resilient attachment and support between the wheel-holding frames and the side frames at each of the four mount corners of the truck 220. Referring particularly to FIGS. 13 and 16, each mount assembly 360 comprises two block components 362 and 364, each of which is generally flat-shaped in that it is of a uniform vertical thickness, having generally parallel upper and lower ends. The outer and inner blocks 362 and 364 are bonded to common upper mounting plate 366 and to a common lower mounting plate 368 and are oriented in a horizontal position. Each plate 366 is affixed to the lower surface, e.g., 370 of the respective side frame, and each plate 368 is affixed to the upper surface 372 of the respective saddle portion 282 of the wheel-holding frame. The elastomeric block components 362 and 364 provide smooth spring elastic restraint between the side frame and wheel-holding frame members in a horizontal plane in both longitudinal and lateral directions. However, being wider in the lateral than in the longitudinal direction as installed, the individual block components will present a higher stiffness to relative lateral motion between the side frame and wheel-holding frame than to a relative longitudinal motion between same.

Because the wheel-holding frames are vertically pivoted to the transom member rather than to the bolster as in truck 220, the wheel-holding frames will not assume significantly different angular positions under different car loadings and related truck spring and bolster height deflections. The only tilting of the wheel-holding frames will be that due to the compressive deflection of the mounts 360. For this truck design, the total range of such tilting deflection of the wheel-holding frames is estimated to be about 1° for a total range of truck loading from spring free to spring solid conditions. Such a degree of angular deflection of the wheel-holding frame member may be accommodated by the elastomeric block components 362 and 364 without producing a significant nonuniform vertical stress distribution within the mount assemblies 360. Thus, by a centered positioning of the mount assemblies 360 over the wheelset axles, a relatively balanced loading can be maintained on the wheel-holding frame member over the entire design load range of the truck as is the case with the support design of truck 20, and the pin connection between wheel-holding frame and truck transom need be designed to withstand essentially only those loadings produced by wheel braking, car coupling impact, and wheel-holding frame articulation movement.

The operation or performance of truck 220 is quite similar to that of the truck 20 in meeting the objectives of superior curve tracking ability, effective control of wheel hunting motion, good ride quality, and good lateral roll stability, and will not be repeated here in any detail. The mount assemblies 263 also afford further vertical elastomeric cushioning in truck 220.

The yieldable elements of the support assemblies joining the side frames and wheelset swiveling assemblies of trucks 20 and 220 preferably are of elastomeric materials such as appropriate natural or synthetic rubbers, because of the spring characteristics readily afforded by members formed of such materials and because of economy. Obviously, the dimensions of these blocks will be determined by the characteristics of particular materials selected and the operational parameters anticipated. To those skilled in the design and application of coil-type springs, it should be apparent that an approximate duplication of the elastomeric mount assemblies is possible using coil springs, even as to the wedge-shaped mount of truck 20, as described in application Ser. No. 408,469 filed Oct. 23, 1973.

Many other embodiments may be devised utilizing the teachings of this invention. By way of example, it is apparent to one skilled in the art that the design of the trucks of the present invention can be varied in the ways suggested for similar trucks in said application Ser. No. 408,469.

Another design embodiment would be a direct connection between the wheel-holding frames within the bolster of the truck 20. Without going into significant detail, it will be pointed out that such a connection is possible within the bolster of that truck, by modifying slightly and combining into one the pin connection assemblies 106 and 108. The resulting assembly would involve one support pin contained within and supported by the bolster and interengaging both wheel-holding frames. Advantages of such a modified truck would be elimination of the interconnecting plate and an increase of the pivot arm length of the wheel-holding frames with respect to the vertical rocking motion of the wheel-holding frames which results from the pin connection of the wheel-holding frames to the bolster. Clearance hole openings would be required in the vertical side faces of the bolster to accommodate support arms added to the wheel-holding frames and extending into the bolster to engage the common support pin. Only minimum vertical height hole openings need be made, however. The wedge-shaped configuration of the elastomeric mount assemblies between the side frame and wheel-holding frame members would permit (or produce) an up and down movement of the wheel-holding frame support arm ends matching that of the bolster as resulting from different truck loadings and bolster height positions. The support arm ends would correspond to the extensions 122 on the wheel-holding frames of the truck 20 and contain the pin connection subassemblies 120. The common support pin and a pair of sleeve spacers similar to the sleeve spacers 114 and 116 of the truck 20 would be held within the bolster. In order to engage the common support pin, the wheel-holding frame support arm ends would be offset laterally to meet side-by-side on the support pin. Such an offsetting of the support arm ends on the wheel-holding frames would present no special problem with respect to the steering function of the wheelset swiveling assemblies or otherwise. The support arm ends on the wheel-holding frames would be held in a relatively fixed lateral relation to one another on the common pin. A more elaborate internal construction of the bolster would be required to hold the support pin, but could be similar to the support arms 110 and 112.

The forms of wheel-holding frames so far discussed not only function as wheelset guidance members, transmitting steering moments between wheelsets, but also, restrain the wheelsets longitudinally with respect to the forces generated by wheel braking and car coupling impact. Accordingly, connections between these wheel-holding frames and the bolster or transom member are required for restraining the inner ends of the wheel-holding frames not only vertically but longitudinally. This arrangement, while involving a somewhat elaborate construction of the wheel-holding frames and their connection to the bolster or transom, has its advantages, among which is the least interference by wheel braking with the steering function of the truck on track curves. Restraint of a wheelset longitudinally (and laterally) need not be accomplished by the wheelset guidance member, however.

The teachings of this invention, particularly that of the truck 220 and the U-shaped steel band interconnecting the wheel-holding frames, will lend themselves to another arrangement. A three-piece truck frame only slightly modified from the conventional when built could be utilized to accommodate wheelset guidance members. The longitudinal restraint of the wheelsets to extreme longitudinal excursions would be accomplished by the wheel-bearing pedestal arms on the side frames, the pedestal arms being spaced apart to provide openings slightly enlarged to allow a degree of fore-and-aft motion of the wheel bearings and bearing adapters for the steering movement desired. The resulting wheelset guidance member would be in the form of a wheel-guidance frame directly connected to or integral with the bearing adapters. Resilient mounting of the side frames on the bearing adapters or wheel-guidance frames by an elastomeric mount would permit and provide the restoring forces to the wheelset guidance movement. As in conventional trucks, the principal lateral restraint of the wheelsets would be by the wheel-bearing pedestal arms on the side frames in cooperation with the bearing adapters or portions thereof of the wheel-guidance frames. The inner portions of the wheel-guidance frames interconnected by the U-shaped steel band element need not be connected to a truck transverse center support structure for vertical support and restraint. Rather, such vertical support and restraint could be carried out by transverse cross pieces positioned on either side of the bolster and simply connected to the side frames. As with the previous wheel-holding frames, the wheel-guidance frames could be rigid one-piece members providing a base for brake component mounting.

A still further application of the teachings of this invention, particularly that of the interconnecting steel band mechanism of truck 220, would be that of a simple conversion of existing three-piece roller bearing trucks into ones having the self-steering capability. Wheel-guidance frames similar to that of the last described embodiment but of lighter construction and formed to fit into the more limited spacing available between the side frames and wheels would connect to the wheel-bearing adapters, also installed in more limited spacing. Resilient mounting of the side frames on the bearing adapters by elastomeric wheel-bearing adapter pads would permit and provide the restoring forces to the wheelset guidance movement. The wheelset turning moments transmitted between wheelsets would be somewhat limited with respect to the curving function but adequate with regard to the control of wheel-hunting motion. Brake rigging would remain mounted on the side frames.

It will be obvious that other modifications of the specific embodiments shown and described may be made, particularly by those skilled in the art, without departing from the spirit and scope of this invention.

It will be seen that railway truck assemblies have been provided which meet the aforestated objects. While particular embodiments of this invention are shown and described herein, it will be understood, of course, that the invention is not to be limited thereto since many modifications may be made by those skilled in the art, particularly in light of the foregoing teachings. It is contemplated, therefore, by the appended claims, to cover any such modifications as fall within the true spirit and scope of this invention.

What is claimed is:

1. A railway truck comprising a pair of longitudinally extending side frames, a transverse center support extending between and supported by said side frames, and a pair of wheelset swiveling assemblies disposed one on each side of said center support and supporting said side frames, means connecting each of said wheelset swiveling assemblies to said side frames at points spaced outward longitudinally of said truck from said center support and permitting relative horizontal movement between said side frames and said swiveling assemblies, means normally supporting an inward portion of each of said wheelset swiveling assemblies on said center support for both substantially universal pivotal movement of the respective wheelset swiveling assembly and lateral movement of the respective inward portion thereof relative to said center support, and means interconnecting said inward portions of said wheelset swiveling assemblies for both conjoint lateral motion of said inward portions of said wheelset swiveling assemblies relative to said center support and permitting limited relative swiveling rotation between said wheelset swiveling assemblies upon such conjoint lateral motion for transmitting steering movement between said supported wheelset swiveling assemblies independently of said center support.

2. A railway truck as in claim 1 wherein said interconnecting means also permits resiliently restrained relative lateral motion between said inward portions of said wheelset swiveling assemblies.

3. A railway truck as in claim 1 or 2 wherein said supporting means includes a resilient element for permitting such relative universal pivotal movement, and slidably interengaging components for permitting such relative lateral movement.

4. A railway truck as in claim 3 wherein said resilient element comprises a resilient sleeve.

5. A railway truck as in claim 3 wherein one of said slidably engaging components comprises a pin.

6. A railway truck as in claim 1 wherein said interconnecting means includes a connector extending beneath said center support and having an end portion on each side of said center support, each of said end portions being joined to said inward portion of the swiveling assembly on the respective side of said center support.

7. A railway truck as in claim 6 wherein said connector comprises a generally "U"-shaped member.

8. A railway truck as in claim 7 wherein said member comprises a rigid plate.

9. A railway truck as in claim 8 wherein said center support structure comprises a bolster extending between said side frames and springs supporting said bolster on said side frames, said plate being slidable laterally along said bolster for such conjoint lateral motion of said inward portions of said wheelset swiveling assemblies.

10. A railway truck as in claim 9 wherein said inward portions of said wheelset swiveling assemblies are supported on respective sides of said bolster.

11. A railway truck as in claim 1, 5, 6 or 7 wherein each of said wheelset swiveling assemblies includes a wheelset and said transverse center support is spring supported and vertically movable relative to said wheelsets.

12. A railway truck as in claim 7 wherein said connector member is flexible.

13. A railway truck as in claim 12 including a transom connected to and supported on said side frames, a bolster extending between said side frames and springs supporting said bolster on said transom, said connector member extending beneath said bolster through spacing provided between said bolster and said transom.

14. A railway truck as in claim 12 wherein said inward portions of said wheelset swiveling assemblies are supported on respective sides of said transom.

15. A railway truck as in claim 1, 6, 7, 8, or 12, wherein said means connecting each of said wheelset swiveling assemblies to said side frames comprises resilient connecting means affording resiliently restrained movement therebetween.

16. A railway truck as in claim 1 wherein each of said connecting means includes an upper plate oriented horizontally and connected to a respective side frame portion and a lower plate oriented horizontally and connected to a respective portion of the underlying wheelset assembly, the lower and upper surfaces of said upper and lower plates respectively having sliding contact engagement.

17. A railway truck as in claim 16 wherein side portions of said upper and lower plates are turned downward and overlap to permit relative sliding movement therebetween longitudinally of said truck and prevent relative sliding movement therebetween in a direction laterally of said truck.

18. A railway truck as in claim 16 or 17 including a resilient element between each of said upper plates and the respective side frame portion and a resilient element between each of the lower plates and the respective portion of the underlying wheelset assembly.

19. A railway truck as in claim 1 wherein each of said inward portions of said wheelset swiveling assemblies includes a first support section mounted thereon, each of said first support sections includes a subassembly mounted therein, and said support means comprises second support sections mounted on said center support and means for connecting each of said subassemblies of said first support sections to said second support sections whereby said subassemblies permit such substantially universal pivotal movement and such lateral movement of said wheelset swiveling assemblies relative to said center support.

20. A railway truck as in claim 19 wherein each of said subassemblies includes an outer sleeve, an inner sleeve, and an elastomeric element mounted between said outer and inner sleeves and said means connecting each of said subassemblies to said second support sections comprises at least one pin adapted for insertion through said inner sleeve and for supportive engagement by said second support sections whereby each of said inner sleeves is adapted for rotational movement around the axis of such pin and the radial compressive and expansive capacity of said elastomeric element permits limited pivotal movement between said inner and outer sleeves and thus between the respective first support section and such pin.

21. A railway truck as in claim 20 wherein said means connecting each of said subassemblies to the respective second support section includes a pin adapted for insertion through said inner sleeve of the respective subassembly and for supportive engagement by the respective second support section on the respective side of said center support and said means interconnecting said wheelset swiveling assemblies comprises a rigid connecting plate spanning the underside of said center support and engaging said pins and spacer elements between said inner sleeves and the portions of said plate engaging said pins whereby lateral movement of one of said inner sleeves is transmitted by said spacer elements, said pins and said connecting plate to the other of said inner sleeves for such conjoint lateral motion of said wheelset swiveling assemblies relative to said center support and axial shearing of said elastomeric elements permit relative axial movement between said inner and outer sleeves of said subassemblies and thus permits resiliently restrained relative lateral movement between said inward portions of said wheelset swiveling assemblies.

22. A railway truck as in claim 21 wherein said outer sleeve and said elastomeric element of each of said subassemblies have cooperating conical wall thicknesses producing radially increasing wall thicknesses of said elastomeric element as measured in cross sectional planes perpendicular to the axis of said elastomeric element moving axially outward from a midpoint on the axis of said elastomeric element.

23. A railway truck as in claim 22 wherein each of said wheelset swiveling assemblies includes a pair of transversely spaced wheels connected by an axle and wheel-holding frame means supported on said axle, said wheel-holding frame means being of unitary construction and extending adjacent the respective connection to the center support and beneath each of the respective side frames at points spaced outward longitudinally of said truck from said center support, said means connecting each of said wheelset swiveling assemblies to said side frames including support means positioned between each of said wheel-holding frame means and said side frames.

24. A railway truck as in claim 23 wherein opposite end portions of each side frame are disposed over the respective underlying wheel-holding frame means and engage said support means, said transverse center support being and supported on mid-portions of said side frames and including a bolster member extending between said side frames, and springs supporting said bolster member, said inward portions of said wheelset swiveling assemblies being supported on respective sides of said bolster.

25. A railway truck as in claim 24 wherein each of said support means includes an elastomeric member having its upper surface affixed to the respective side frame end portion and its lower surface affixed to the respective underlying wheel-holding frame means to transmit compressive loads from the respective side frame to the respective underlying wheel-holding frame means through said elastomeric member.

26. A railway truck as in claim 25 wherein each of said support means includes a further assembly comprising a first elastomeric component having its upper surface affixed to the respective side frame end portion, a first member affixed on one side to the lower surface of said first component and having an outer contact surface, a second elastomeric component having its lower surface affixed to the respective underlying wheel-holding frame means, a second member affixed on one side to the upper surface of said second component and having an outer contact surface in sliding contact engagement with said outer surface of said first member, said further assembly being positioned adjacent the respective elastomeric member and oriented to transmit compressive loads from the respective side frame end portion to the respective wheel-holding frame means through said elastomeric components and the interface between said surfaces.

27. A railway truck as in claim 26 wherein said elastomeric members of each of said support means is disposed outwardly of the respective further assembly relative to said center support, and each of said elastomeric members is of greater vertical height than the respective further assembly.

28. A railway truck as in claim 27 wherein said elastomeric member and said first and second elastomeric components of each of said support means are generally wedge-shaped blocks having upper and lower surfaces diverging from one another in a direction away from said center support.

29. A railway truck as in claim 28 wherein said elastomeric members and said elastomeric components of said further assembly of each of said support means have a configuration and size such that they have an overall size and configuration continuous with that of a unitary, wedge-shaped block.

30. A railway truck as in claim 29 wherein each of said side frame end portions and respective underlying wheel-holding frame means include generally parallel spaced pairs of inclined surfaces extending in a diverging direction away from said center support, said elastomeric member of each support means having upper and lower end surfaces affixed to respective inclined surfaces farthest from the center support, said further assembly of each of said support means comprising first and second elastomeric components having upper and lower end surfaces, respectively, affixed to respective inclined surfaces nearest to the center support.

31. A railway truck as in claim 26 wherein each of said support means includes: an upper plate; the upper surfaces of said elastomeric member and said first elastomeric component being bonded to said upper plate; said upper plate being affixed to the respective side frame; the lower surfaces of said elastomeric member and said second elastomeric component being bonded to a first lower plate; the lower surface of said first elastomeric component being bonded to a second lower plate; a third lower plate in sliding abutting relation to the lower surface of said second lower plate; the upper surface of said second elastomeric component being bonded to said third lower plate; and said first lower plate being affixed to the respective underlying wheel-holding frame means.

32. A railway truck as in claim 31 wherein side portions of said second and third lower plates are turned downward and overlap to permit relative sliding fore-and-aft in a direction toward the center support structure and to prevent relative sliding movement in a lateral direction.

33. A railway truck as in claim 32 wherein each of said wheelset swiveling assemblies comprises a wheelset including the respective pair of wheels and having wheel bearings positioned outwardly of said wheels, and each of said wheel-holding frame means comprises a pair of transversely spaced bearing portions disposed on the outward sides of said wheels for engaging said wheel bearings, and a load structure extending outwardly of each such bearing engaging portion, each of said support means being joined to one of said load structures.

34. A railway truck as in claim 32 wherein each of said wheel-holding frame means comprises a pair of transversely spaced bearing portions for engaging a wheelset which includes the respective pair of wheels and axle, each of said bearing portions defining a pedestal opening and including a bearing surface across the upper end of each such opening, each of the wheelsets including wheel bearings and bearing adaptors engaged in said pedestal openings of the respective wheel-holding frame means, and elastomeric pads between each of said adaptors and said upper surface of the respective pedestal opening.

35. A railway truck comprising a pair of longitudinally extending side frames, a transverse center support structure extending between and supported by said side frames, said structure including a transverse member connected to and supported on said side frames and a center load support member disposed in overlying relation to said transverse member, and a pair of wheelset swiveling assemblies disposed one on each side of said center support structure and supporting said side frames, means connecting each of said wheelset swiveling assemblies to said side frames at points spaced outwardly longitudinally of said truck from said center support structure and permitting relative horizontal movement between said side frames and said swiveling assemblies, means supporting an inward portion of each of said wheelset swiveling assemblies on said center support structure for both substantially universal pivotal movement of the respective wheelset swiveling assembly and lateral movement of the respective inward portion thereof relative to said center support structure, and means interconnecting said inward portions of said wheelset swiveling assemblies for both conjoint lateral motion of said inward portions of said wheelset swiveling assemblies relative to said center support structure and permitting limited relative swiveling rotation between said wheelset swiveling assemblies upon such conjoint lateral motion, said interconnecting means comprising a flexible "U"-shaped connecting member spanning the underside of said center load support member and engaging said inward portions of said wheelset swiveling assemblies for transmitting steering movements therebetween.

36. A railway truck as in claim 35 wherein end portions of said "U"-shaped connecting member comprise curved, semi-circular segments and said inward portions include cylindrical shaped grooves, said segments adapted to fit into said grooves to provide rigid connections of said connecting band to said inward portions.

37. A railway truck as in claim 36 wherein said member is a band fabricated from spring steel.

38. A railway truck as in claim 37 wherein each of said wheelset swiveling assemblies includes a pair of transversely spaced wheels connected by an axle and wheel-holding frame means supported on said axle, said wheel-holding frame means being of unitary construction and extending adjacent the respective connection to the center support structure and beneath each of the respective side frames at points spaced outward longitudinally of said truck from said center support structure, said means connecting each of said wheelset swiveling assemblies to said side frames including support means positioned between each of said wheel-holding frame means and said side frames.

39. A railway truck as in claim 38 wherein each of said support means comprises an elastomeric mount positioned between and affixed to the respective side frame end portion and underlying wheel frame means.

40. A railway truck as in claim 35 wherein said center load support member is a bolster, and including springs supporting said bolster on said transverse member, and wherein said supporting means supports said inward portions of said wheelset swiveling assemblies on said transverse member.

41. A railway truck as in claim 40 wherein said connecting member extends beneath said bolster through spacing provided between said bolster and said transverse member.

42. A railway truck as in claim 40 wherein each of said side frames is of a truss design including spaced upper and lower chord sections in the mid-portion thereof and spaced struts joining said upper and lower chord sections and defining a bolster opening therebetween, opposite ends of said transverse member and said bolster being received in said bolster openings of said side frames.

43. A railway truck as in claim 42 including means supported adjacent each side of each end of said bolster and having sliding frictional contact with the respective adjacent side of said bolster for snubbing relative lateral and vertical movement between said bolster and said side frames.

44. A railway truck as in claim 43 wherein each end of said transverse member extends beyond the respective side frame, said springs between said transverse member and said bolster being disposed outboard of the centerline of each of said side frames.

45. A railway truck as in claims 35, 40 or 41 wherein said means connecting each of said wheelset swiveling assemblies to said side frames comprises resilient connecting means affording resiliently restrained movement therebetween.

46. A railway truck assembly for supportably engaging a railway vehicle comprising a pair of longitudinally extending side frames, a transverse center support extending between and supported by said side frames, a pair of wheelest swiveling assemblies disposed one on each side of said center support and extending in underlying relation to said side frames at points spaced outward longitudinally of said truck from said center support for supporting said truck assembly, means supporting each of said side frames on the respective underlying wheelset swiveling assemblies at such points spaced outward longitudinally of said truck assembly from said center support and permitting relative horizontal movement therebetween, means supporting said wheelest swiveling assemblies against movement resultant from application thereto of longitudinal forces such as those resulting from car coupling impact and braking, and means including a flexible "U"-shaped element extending beneath said center support and movable independently of said center support and connected to said wheelset swiveling assemblies for transmitting steering movements therebetween.

47. A railway truck assembly as in claim 46 wherein said flexible "U"-shaped element is rigidly connected to each of said wheelset swiveling assemblies.

48. A railway truck as in claim 46 wherein said "U"-shaped element comprises a flexible "U"-shaped bar.

49. A railway truck as in claim 46 wherein said "U"-shaped element comprises a flexible "U"-shaped band.

50. A railway truck as in claim 46 including a transverse member connected to and supported on said side frames, said transverse center support comprising a bolster extending between said side frames, and springs supporting said bolster on said transverse member, said flexible "U"-shaped member extending beneath said bolster through spacing provided between said bolster and said transverse member.

51. A railway truck assembly as in claim 46, 47, 48, 49 or 50 wherein said supporting means comprises means resiliently connecting said side frames to the respective underlying wheelset assemblies and providing resiliently restrained movement therebetween.

* * * * *

UNITED STATES PATENT AND TRADEMARK OFFICE

CERTIFICATE OF CORRECTION

PATENT NO. : 4,244,297

DATED : January 13, 1981

INVENTOR(S) : Dale E. Monselle

It is certified that error appears in the above-identified patent and that said Letters Patent are hereby corrected as shown below:

On The Title Page:

Column 2, line 9, "Locomotive" should read -- Locomotives --. Column 2, line 11, "Sheffle" should read -- Sheffel --. Column 2, line 12, "Internatinal" should read -- International --.

Column 1, line 6, "4,083,316" should read -- 4,003,316 --. Column 7, line 10, "laterial" should read -- lateral --. Column 9, line 16, "thickness" should read -- thicknesses --. Column 26, line 36 (claim 37) after "said" insert -- connecting --. Column 27, line 25 (claim 46) "wheelest" should read -- wheelset --. Column 28, line 2 (claim 46) "wheelest" should read -- wheelset --.

Signed and Sealed this

*Fifteenth* Day of *September 1981*

[SEAL]

*Attest:*

GERALD J. MOSSINGHOFF

*Attesting Officer*

*Commissioner of Patents and Trademarks*